US008615896B2

(12) United States Patent
Chung

(10) Patent No.: US 8,615,896 B2
(45) Date of Patent: Dec. 31, 2013

(54) CLOTHING DRYER

(75) Inventor: Young Suk Chung, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 511 days.

(21) Appl. No.: 12/461,618

(22) Filed: Aug. 18, 2009

(65) Prior Publication Data

US 2010/0071224 A1 Mar. 25, 2010

(30) Foreign Application Priority Data

Sep. 23, 2008 (KR) ..... 10-2008-0093009

(51) Int. Cl.

| | |
|---|---|
| ***F26B 11/02*** | (2006.01) |
| ***F26B 21/06*** | (2006.01) |
| ***F26B 19/00*** | (2006.01) |
| ***F03B 11/02*** | (2006.01) |

(52) U.S. Cl.

USPC ..... 34/119; 34/76; 34/229; 415/206

(58) Field of Classification Search

USPC ..... 34/218, 265, 292, 293, 395, 468, 76, 34/119, 229; 415/204, 206, 213.1, 214.1

See application file for complete search history.

(56) References Cited

U.S. PATENT DOCUMENTS

| | | | | |
|---|---|---|---|---|
| 6,767,184 | B2 * | 7/2004 | Kim et al. | 415/204 |
| 7,093,377 | B2 * | 8/2006 | Doh et al. | 34/596 |
| 7,144,219 | B2 * | 12/2006 | Hancock | 415/212.1 |
| 7,926,202 | B2 * | 4/2011 | Dittmer et al. | 34/595 |
| 2006/0051204 | A1 * | 3/2006 | Lyons | 415/204 |

FOREIGN PATENT DOCUMENTS

| | | |
|---|---|---|
| EP | 1925712 | 5/2008 |
| KR | 10-2005-0062009 | 6/2005 |
| WO | 2006/114802 | 11/2006 |
| WO | WO 2006114802 A1 * | 11/2006 |

OTHER PUBLICATIONS

European Search Report dated Dec. 7, 2009, issued in European Patent Application No. 09168224.5.

* cited by examiner

*Primary Examiner* — Kenneth Rinehart
*Assistant Examiner* — John McCormack
(74) *Attorney, Agent, or Firm* — Staas & Halsey LLP

(57) ABSTRACT

A clothing dryer having a cover structure capable of increasing quantity of air generated from a cooling fan. The clothing dryer includes a first cover covering the cooling fan and a second cover connected to the first cover. A cutoff is provided at a connection area between the first cover and the second cover to branch a flow of air and is positioned below a rotational center of the cooling fan.

18 Claims, 7 Drawing Sheets

FIG. 6

| ANGLE Θ | 30 Deg | 40 Deg | 60 Deg | 70 Deg | 90 Deg |
|---|---|---|---|---|---|
| QUANTITY OF AIR(CMM) | 1.59 | 1.97 (24%↑) | 2.4 (50%↑) | 1.78 (11.9%↑) | 1.58 (-0.6↓) |

CLOTHING DRYER

CROSS-REFERENCE TO RELATED APPLICATIONS

This application claims the benefit of Korean Patent Application No. 10-2008-0093009 filed on Sep. 23, 2008, in the Korean Intellectual Property Office, the disclosure of which is incorporated herein by reference.

BACKGROUND

1. Field

Embodiments of the present invention relates to a clothing dryer. More particularly, embodiments of the present invention relate to a cover structure of a clothing dryer, capable of increasing quantity of air generated from a cooling fan.

2. Description of the Related Art

A clothing dryer is an appliance for drying articles contained in a dry box by blowing hot air into the dry box. In general, the clothing dryer can be mainly classified into either an exhausting-type dryer, in which air having high temperature and high humidity is passed through a dry box and then exhausted to the outside, or a condensing-type dryer, in which air having high temperature and high humidity is passed through a dry box and then re-circulated into the dry box after humidity contained in the air has been removed.

The condensing type dryer includes a hot air circulation path for circulating air having high temperature and high humidity, and an external air path for receiving and exhausting external air. A condenser is installed at an intersection between the hot air circulation path and the external air path. The air having high temperature and high humidity passes through the condenser via the hot air circulation path and is heat-exchanged with external air that passes through the condenser via the external air path. That is, the air having a high temperature and a high humidity is condensed due to the temperature difference between the high-temperature air and the external air, so that humidity contained in the air having high temperature and high humidity is removed.

When removing humidity from the air using the condenser, the dehumidification effect may be improved proportionally to the quantity of high-temperature air and external air passing through the condenser. In order to increase the quantity of air passing through the condenser, there has been suggested a method for enlarging a size of a fan. However, since there is a limitation in the size of a circulation fan, which is installed on the hot air circulation path, and a cooling fan, which is installed on the external air path, such a method may limit an increase of the quantity of air.

SUMMARY

Accordingly, it is an aspect of embodiments of the present invention to provide a clothing dryer capable of increasing quantity of air generated from a cooling fan by modifying a structure of a cover that forms an air path.

Additional aspects and/or advantages will be set forth in part in the description which follows and, in part, will be apparent from the description, or may be learned by practice of the invention.

The foregoing and/or other aspects of embodiments of the present invention are achieved by providing a clothing dryer including a base and a base cover coupled with the base to form a fluid path, wherein the base cover includes a first cover covering a cooling fan and a second cover connected to the first cover, and wherein a cutoff is provided at a connection area between the first cover and the second cover to branch the fluid path and is located below a rotational center of the cooling fan.

A cutoff member is provided at the connection area between the first cover and the second cover along an outer peripheral surface of the cooling fan, and the cutoff is provided at a lower end of the cutoff member.

The cutoff member is connected to the first cover, thereby forming a spiral configuration together with the first cover about the rotational center of the cooling fan.

The cutoff member is integrally formed with the second cover though an injection molding process.

The cutoff member is coupled to the first cover or the second cover.

The first cover includes a second support section supported by the cutoff member.

The second support includes a flat surface and an inclined surface, which are formed in a stepped configuration, the flat surface is supported on an upper end of the cutoff member, and the inclined surface is supported on a lateral side of the cutoff member.

The first cover includes a first support section supported by the second cover.

The first cover includes a spiral section, and the second cover includes a linear section.

The base includes an external air path and a hot air circulation path, a condenser is installed at an intersection between the external air path and the hot air circulation path, and the cooling fan is installed in the external air path.

The condenser and the cooling fan are installed in a recess of the base.

According to another aspect, there is provided a clothing dryer including a base, a cooling fan installed on the base, a cooling fan cover coupled to the base to cover the cooling fan, and a cutoff member connected to the cooling fan cover to guide a flow of air generated from the cooling fan, wherein the cooling fan cover forms a spiral configuration together with the cutoff member along an outer peripheral surface of the cooling fan in a range of 180 degrees or more.

A part of the cutoff member is located below a rotational center of the cooling fan.

According to still another aspect, there is provided a clothing dryer including a base, a base cover provided on the base, a cooling fan installed on a fluid path formed in the base, and a cutoff member connected to the base and extending along an outer peripheral surface of the cooling fan, wherein at least a part of the cutoff member is located below a rotational center of the cooling fan.

According to the clothing dryer of embodiments of the present invention, a position of a cutoff can be optimized within a predetermined space, thereby increasing the quantity of air generated from the cooling fan.

Therefore, quantity of air generated from the cooling fan can be increased, so that the condensing operation is promoted and drying efficiency is improved.

According to another aspect, there is provided an external air path duct of a clothing dryer, the duct including a first cover covering a cooling fan, a second cover connected to the first cover, a cutoff member provided at a connection area between the first cover and the second cover to branch the external air path and located below a rotational center of the cooling fan.

A cutoff positioned on the end of the cutoff member may be inclined 70 degrees or less from a vertical line passing through the rotational center of the cooling fan.

The cutoff member may be separate from the first cover and the second cover.

The first cover may include a sealing structure formed by a first support section to prevent airflow from the cooling fan from exiting out the connection area.

The first cover may include a section having a semi-cylindrical shape.

The cutoff member may be located at an end of the second cover provided around the cooling fan.

The second cover may cover a condenser.

A top of the external air path duct may be formed by the first and second covers, and a bottom of the external air path duct may be formed in a base of the clothing dryer.

The cutoff member may have a wedge shape with one side being curved proportional to the curvature of the cooling fan, and another side extending away from the cooling fan.

A cutoff may be positioned on the end of the cutoff member and be located where the one side meets the other side.

BRIEF DESCRIPTION OF THE DRAWINGS

These and/or other aspects and advantages will become apparent and more readily appreciated from the following description of the embodiments, taken in conjunction with the accompanying drawings of which:

FIG. 6 illustrates a chart showing quantity of air according to a position of a cutoff of a cooling fan.

DETAILED DESCRIPTION OF EMBODIMENTS

Figure 1:
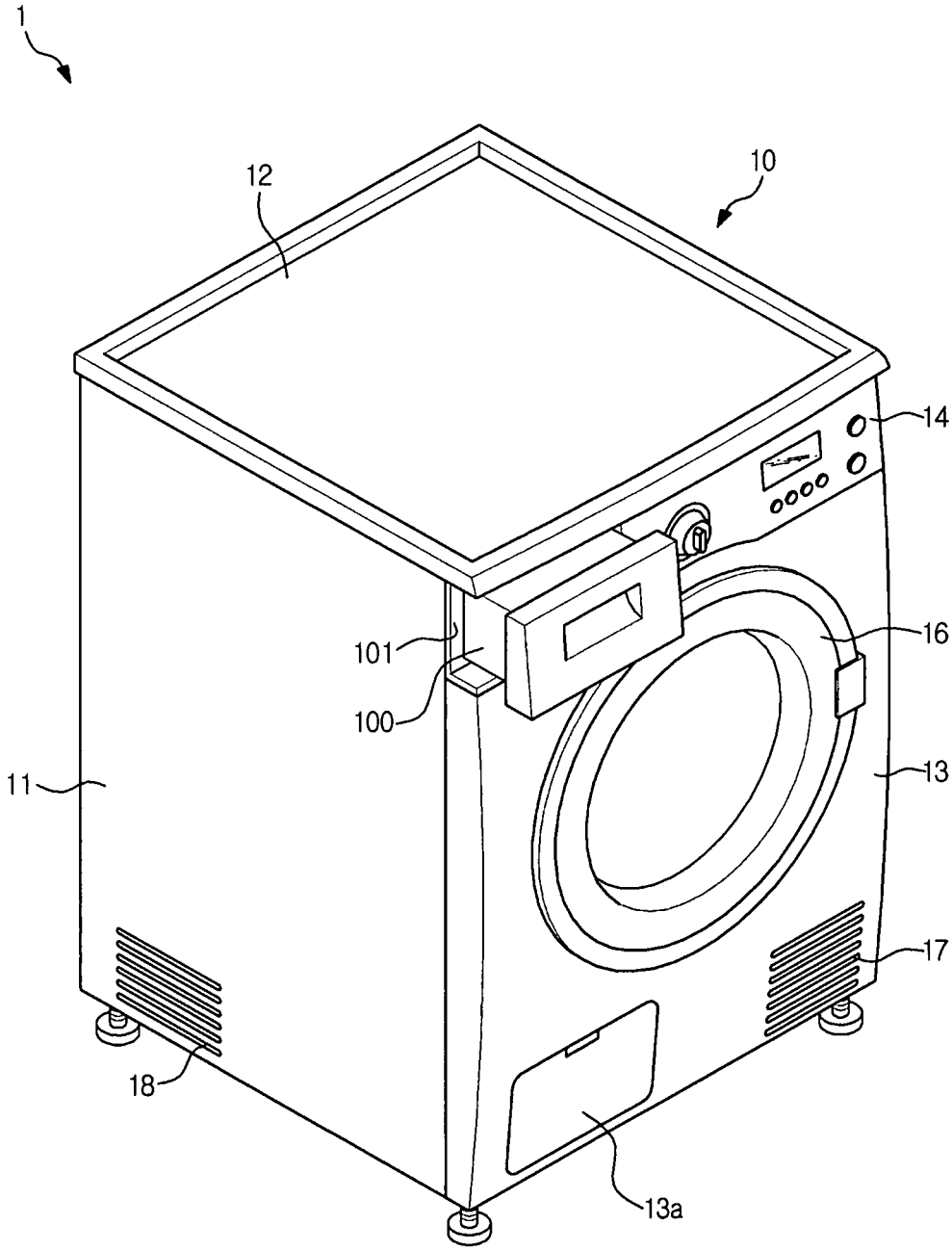
FIGS. 1 and 2 illustrate views showing an external appearance and an internal structure, respectively, of a clothing dryer according to embodiments of the present invention.

Reference will now be made in detail to the embodiments of the present invention, examples of which are illustrated in the accompanying drawings, wherein like reference numerals refer to the like elements. The embodiments are described below to explain the present invention by referring to the figures.

Figure 2:
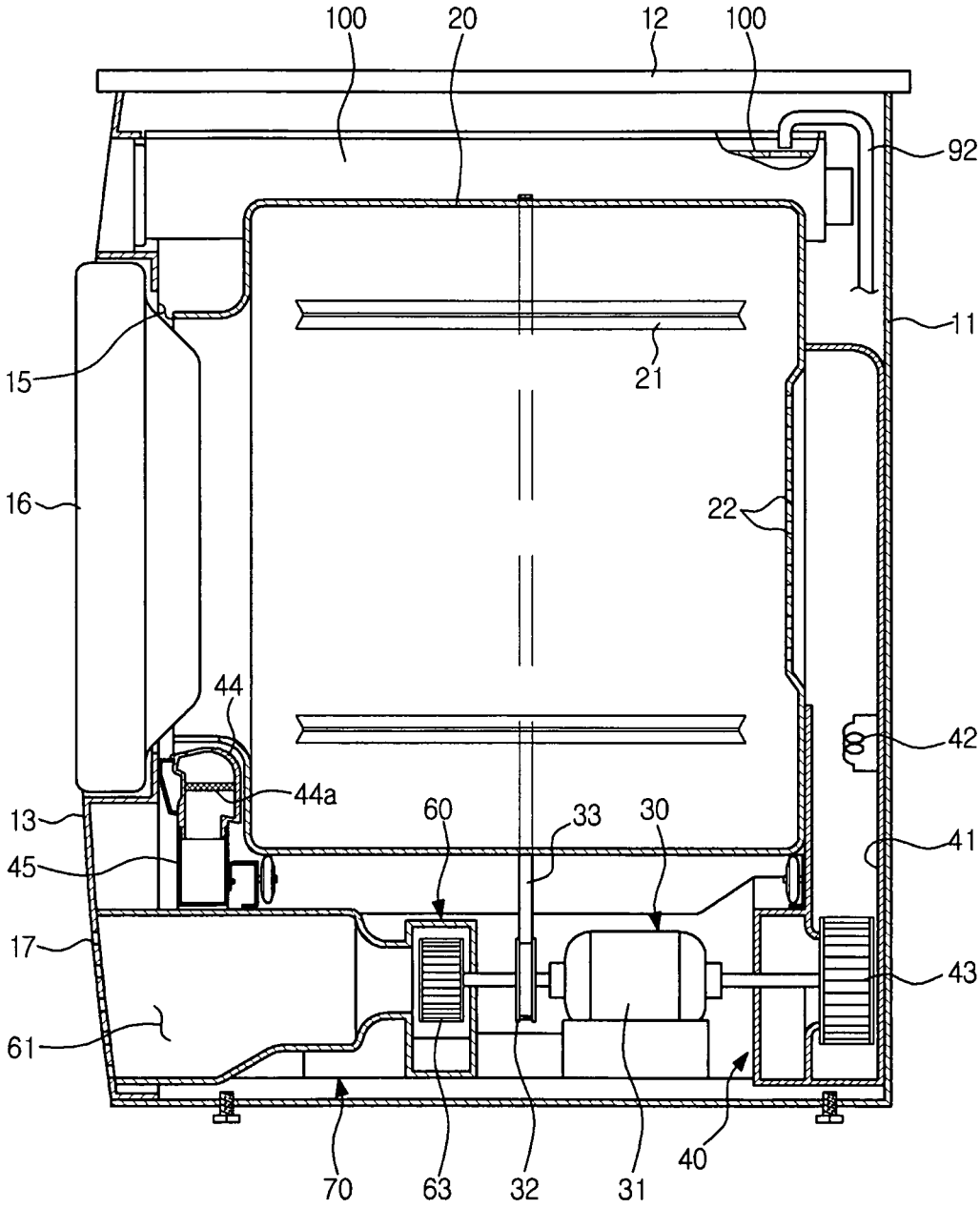
Figure 3:
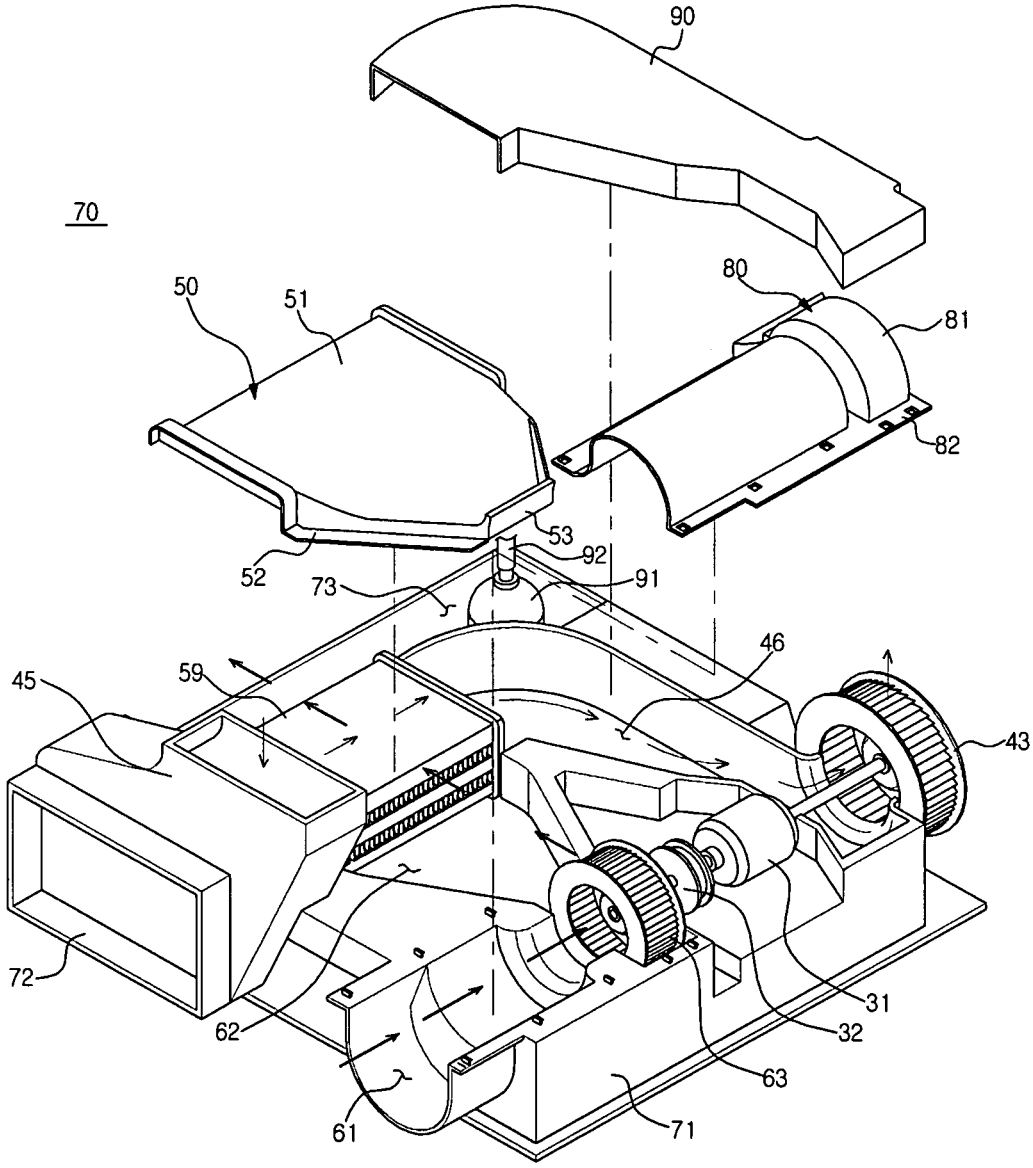
FIG. 3 illustrates a view of a base assembly of a clothing dryer according to embodiments of the present invention.

FIGS. 1 and 2 illustrate views of an external appearance and an internal structure of a clothing dryer 1, respectively, according to embodiments of the present invention. FIG. 3 illustrates a view showing a base assembly of the clothing dryer 1 according to embodiments of the present invention.

As shown in FIGS. 1, 2, and 3, the clothing dryer 1 includes a body 10, a rotating drum 20, a driving unit 30, a drying unit 40, a condenser 59, a cooling unit 60, and a water tank 100.

The body 10 includes a cabinet 11 with an exhaust port 18, a top cover 12 covering an upper portion of the cabinet 11, a front panel 13 installed at a front surface of the cabinet 11, a suction port 17 on the front panel 13, and a cover 13*a* in the front panel 13, a water tank housing 101 for receiving the water tank 100, and a control panel 14 on which various buttons and displays are installed to allow a user to control the clothing dryer 1. According to embodiments, the water tank housing 101 may be integrally formed with the control panel 14 by using a single frame. However, the water tank housing 101 may be prepared separately from the control panel 14.

An input port 15 is formed at the front surface of the body 10 to allow the user to input drying articles into the rotating drum 20, and a door 16 is hinged to one side of the input port 15 to open/close the input port 15.

The rotating drum 20 is rotatably installed in the body 10. A plurality of lifers 21 are installed along the circumference of the rotating drum 20. The drying articles are moved up and dropped down by the lifters 21 so that the drying articles can be effectively dried.

A front surface of the rotating drum 20 is open, and a hot air inlet port 22 is formed at a rear surface of the rotating drum 20. Air heated by the drying unit 40 is introduced into the rotating drum 20 through the hot air inlet port 22.

As shown in FIGS. 2 and 3, a base assembly is provided below the rotating drum 20. The base assembly 70 includes a base 71 having fluid paths 46, 61 and 62, and a plurality of base covers 50, 80 and 90 covering the base 71. That is, the base 71 is mainly divided into the hot air circulation path 46 for circulating hot air and external air paths 61 and 62, in which the external air paths 61 and 62 include the suction path 61 for receiving external air and the exhaust path 62 for exhausting the external air. The suction path 61 and the exhaust path 62 are recessed in the base 71 by a predetermined depth, and a region between the suction path 61 and the exhaust path 62 is recessed by a predetermined depth such that a cooling fan 63 can be installed in the region.

The base covers 50, 80, 90 include first to third covers. The first cover is the cooling cover 80 for covering the cooling fan 63 and the suction path 61, the second cover is the condenser cover 50 for covering the condenser 59 and the exhaust path 62, and the third cover is the hot air circulation path cover 90 for covering the hot air circulation path 46. The first cover can be divided into two parts to cover the cooling fan 63 and the suction path 61, respectively, or can be integrally formed. The second cover can also be divided into two parts to cover the condenser 59 and the exhaust path 62, respectively, or can be integrally formed. The base covers 50, 80 and 90 cover the upper portions of the condenser 59, the cooling fan 63 and the fluid paths 46, 61 and 62, thereby forming a duct structure, which serves as an air passage, together with the base 71. The duct structure including the cooling fan 63 serves as a blowing device.

The rotating drum 20 is driven by the driving unit 30. As shown in FIGS. 2 and 3, the driving unit includes a driving motor 31 installed on the base assembly 70, a pulley 32 rotated by the driving motor 31, and a belt 33 connecting the pulley 32 to the rotating drum 20 to transfer driving force of the driving motor 31 to the drum 20.

The drying unit 40 heats air and circulates the heated air to dry articles contained in the rotating drum 20. The drying unit 40 includes a heating duct, 41, a heater 42, a circulation fan 43, a hot air discharge duct 44, a connection duct 45 and the hot air circulation path 46.

The heating duct 41 is installed at a rear of the rotating drum 20 and is communicated with the rotating drum 20 through the hot air inlet port 22 of the rotating drum 20. The heating duct 41 is communicated with the hot air circulation path 46.

The heater 42 and the circulation fan 43 are provided in the heating duct 41. The heater 42 heats the air and the circulation fan 43 receives air from the hot air circulation path 46 and discharges the air into the heating duct 41, thereby forming a circulation air flow that circulates through the rotating drum 20. The circulation fan 43 may be driven by the driving motor 31 when the driving motor 31 drives the rotating drum 20.

The hot air discharge duct 44 is positioned at a front of the rotating drum 20 to allow air having high temperature and high humidity, which has passed through the rotating drum 20, to the outside. A filter 44*a* is installed in the hot air discharge duct 44 to filter impurities, such as lint.

The connection duct 45 connects the hot air discharge duct 44 to the hot air circulation path 46, and the hot air circulation path 46 connects the connection duct 45 to the heating duct 41 to allow hot air to circulate. As shown in FIG. 3, the connection duct 45 and the hot air circulation path 46 may be integrally formed with the base assembly 70.

Referring now to FIGS. 1, 2, and 3, the condenser 59 is installed at the intersection between the hot air circulation path 46 and the exhaust path 62. The condenser 59 removes humidity from the air being circulated with high temperature and high humidity. That is, the hot air is cooled by cold air supplied from the cooling unit 60 when the hot air passes through the condenser 59, so that humidity contained in the hot air is condensed.

The cooling unit 60 includes the suction path 61, the exhaust path 62 and the cooling fan 63. One side of the suction path 61 is connected to a suction port 17 formed at a front lower portion of the body 10, and the other side of the suction path 61 is connected to a suction port of the cooling fan 63. One side of the exhaust path 62 is connected to an exhaust port of the cooling fan 63. The exhaust path 62 extends toward the hot air circulation path 46 and the condenser 59 is disposed at a region where the exhaust path 62 meets the hot air circulation path 46.

The condenser 59 is configured to allow the hot air passing through the hot air circulation path 46 of the drying unit 40 to make a heat-exchange with the cold air passing through the exhaust path 62 of the cooling unit 60 while being isolated from each other.

The condenser 59 can be installed on the base assembly 70 or separated from the base assembly 70 through an opening 72 formed at one side of the front portion of the base assembly 70, and an opening formed at a lower portion of the front panel 13 corresponding to the opening 72. The opening of the front panel 13 is open/closed by a cover 13*a*.

As the drying cycle starts, the driving motor 31 and the heater 42 are operated. Thus, the circulation fan 43 is rotated by the driving motor 31 so that the air flow is generated and the heater 42 heats the air that passes through the heating duct 41. The air heated in the heating duct 41 is introduced into the rotating drum 20 through the hot air inlet port 22, and condenses the humidity contained in the articles placed in the rotating drum 20, thereby drying the articles. The air having high temperature and high humidity contained in the rotating drum 20 is introduced to the condenser 59 through the hot air discharge duct 44 and the connection duct 45. The air introduced into the condenser 59 is cooled while passing through the condenser 59, so that humidity contained in the air is removed. Thus, the air having no humidity is guided to the heating duct 41 through the hot air circulation path 46. Then, the air is heated again by the heater 42 and supplied to the rotating drum 20.

In addition, the driving force of the rotating motor 31 is transferred to the rotating drum 20 through the belt 33 so that the rotating drum 20 is rotated. Thus, the articles contained in the rotating drum 20 can be uniformly dried.

In addition, the driving motor 31 rotates the cooling fan 63. As the cooling fan 63 rotates, external air is introduced into the body 10 through the suction port 17 and then guided to the condenser 59 through the external air paths 61 and 62 formed in the base assembly 70. The air guided to the condenser 59 has a relatively low temperature. The air having the relatively low temperature cools the hot air that passes through the condenser 59 and is exhausted to the outside through the exhaust port 18 formed in the body 10.

Condensing water may be generated during the above drying process. As shown in FIG. 3, the condensing water is collected in a condensing water storage unit 73 formed in the base assembly 70. The condensing water collected in the condensing water storage unit 73 is pumped by a pump 91 and then guided to the water tank 100 (FIG. 2) through a condensing water discharge pipe 92.

As mentioned above, the external air having the relatively low temperature is heat-exchanged with the air having the high temperature and high humidity at the condenser 59. Thus, the quantity of air introduced into the condenser 59 must be increased in order to promote the heat exchange operation. That is, the quantity of external air having the relatively low temperature, which is introduced into the condenser 59, must be increased by increasing the quantity of air generated from the cooling fan 63 and the quantity of air having the high temperature and high humidity, which is introduced into the condenser 59, must be increased by increasing the quantity of air generated from the circulation fan 43.

Figure 4:
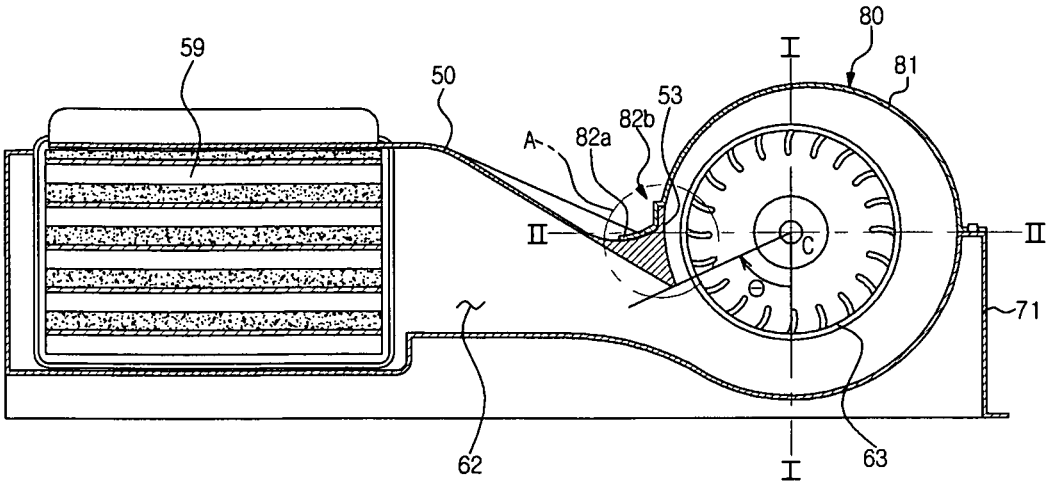
FIG. 4 illustrates a view of a duct structure of an external air path formed in a clothing dryer according to embodiments of the present invention.
Figure 5:
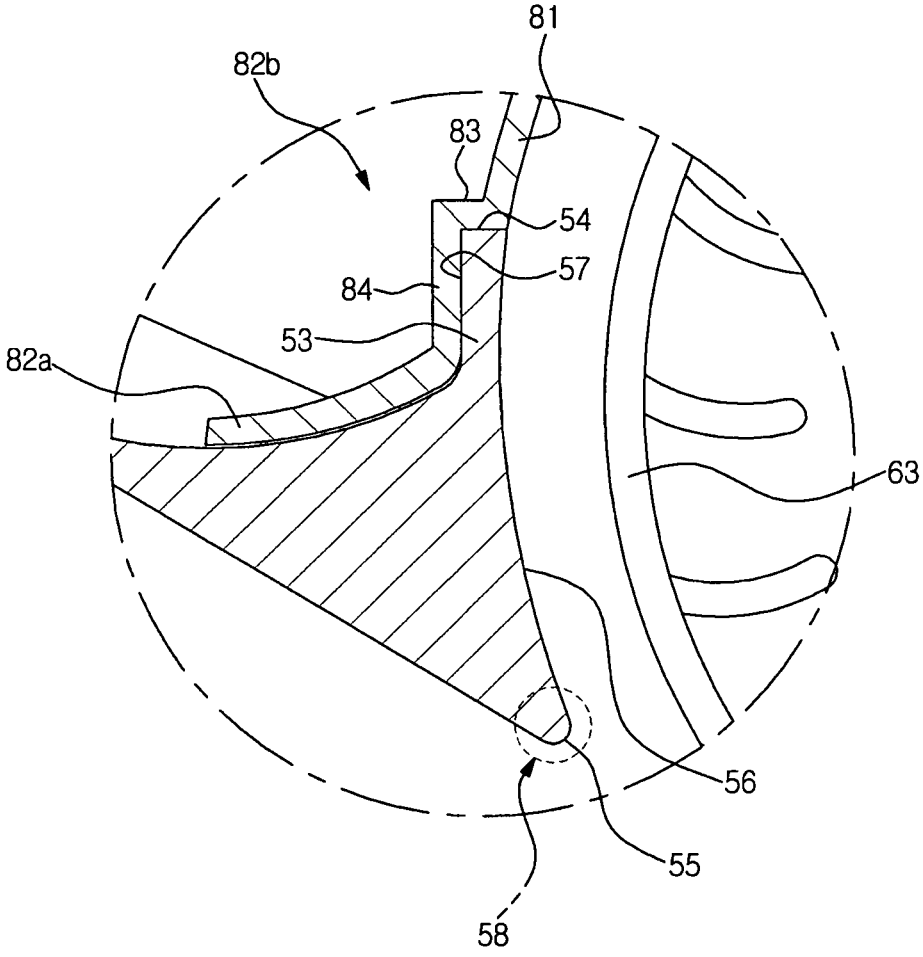
FIG. 5 illustrates an enlarged view of an "A" portion, for example, the "A" portion shown in FIG. 4.

FIG. 4 illustrates a view of a duct structure of an external air path formed in a clothing dryer according to embodiments of the present invention, and FIG. 5 is an enlarged view of an "A" portion, for example, the "A" portion shown in FIG. 4.

As shown in FIGS. 3 to 5, the duct structure of the external air paths 61 and 62 for the external air having the relatively low temperature is formed by coupling the condenser cover 50 with the cooling fan cover 80 and the base 71. The condenser cover 50 is installed on the base 71 to cover the upper portions of the condenser 59 and the exhaust path 62, and then the cooling fan cover 80 is installed on the base 71 to cover the upper portions of the cooling fan 63 and the suction path 61. Since a sealing structure is formed by a first support section 82*a* of the cooling fan cover 80, which is supported on the condenser cover 50, the air generated from the cooling fan 63 can be prevented from flowing between the condenser cover 50 and the cooling fan cover 80.

The cooling fan cover 80 includes a spiral section 81 having a semi-cylindrical shape and surrounding the cooling fan 63, and a support section 82 which protrudes outward from the spiral section 81 and supported by the base 71 and the condenser cover 50. The cooling fan cover 80 is fabricated through an injection molding process, in which the spiral section 81 of the cooling fan cover 80 is fabricated in the semi-cylindrical structure. If the cooling fan cover 80 has a configuration greater than the semi-cylindrical structure, the cooling fan cover 80 may be damaged when an upper mold is separated from a lower mold during the injection molding process.

The condenser cover 50 includes a linear section 51 that covers the upper portions of the condenser 59 and the exhaust path 62, and a support section 52 protruding outward from the linear section 51 and supported by the base 71. In addition, the condenser cover 50 includes a cutoff member 53 provided around the cooling fan 63. As shown in FIG. 4, the condenser cover 50 can be integrally formed with the cutoff member 53 through the injection molding process. Since the cooling fan cover 80 has the semi-cylindrical structure, a problem may occur during the injection molding process if the cutoff member 53 is formed in the cooling fan cover 80. For this reason, the cutoff member 53 is provided in the condenser cover 50, rather than the cooling fan cover 80.

The cutoff member 53 has a side surface 56 which is curved along the cooling fan 63. The cutoff member 53 is longitudinally disposed such that an upper end 54 of the cutoff member 53 can be supported by a second support section 82*b* of the cooling fan cover 80. Thus, as shown in FIGS. 4 and 5, the side surface 56 of the cutoff member 53 is connected to the spiral section 81 of the cooling fan cover 80, so that the cooling fan 63 may have a spiral configuration about a rotational center C. That is, the spiral section 81 may extend downward along the outer peripheral surface of the cooling fan 63 due to the cutoff member 53. If the cutoff member 53 and the cooling fan cover 80 have the above configuration, an Archimedes spiral configuration can be realized around the cooling fan 63, so that the flow rate of air can be increased.

A lower end 55 of the cutoff member 53 serves as a start point of the exhaust path 62, so the lower end 55 of the cutoff member 53 is called a "cutoff" 58. The flow of air generated from the cooling fan 63 may be branched on the basis of the cutoff. That is, referring to FIG. 4, the flow of air is branched in the left and right directions about the cutoff 58. The quantity of air generated from the cooling fan 63 may vary depending on the position of the cutoff 58. The quantity of air generated from the cooling fan 63 can be measured based on an inclination angle θ of the cutoff 58 relative to a virtual line (I-I), which is a vertical line passing through the rotational center C.

FIG. 6 illustrates a chart showing the quantity of air according to the position of the a cutoff of the cooling fan, for example, the cutoff 58 of the cooling fan 63 (FIG. 5), as determined by the angle θ. Referring to FIGS. 4 and 6, the quantity of air generated from the cooling fan 63 can be maximized when the cutoff 58 is inclined relative to the virtual line I-I of the cooling fan 63 at an angle θ of about 60 degrees. In other words, if the cutoff member 53 is prepared such that the cutoff 58, which is arranged at the connection area between the condenser cover 50 and the cooling fan cover 80 to branch the air flow, is positioned below a virtual line (II-II), which is a horizontal line passing through the rotational center C of the cooling fan 63, the quantity of air generated from the cooling fan 63 can be increased.

The cutoff member 53 is supported by the second support section 82*b*, so that the dual sealing structure is formed between the condenser cover 50 and the cooling fan cover 80. That is, the second support section 82*b* has a stepped structure in such a manner that a flat surface 83 of the second support section 82*b* is supported on the upper end 54 of the cutoff member 53 and an inclined surface 84 of the second support section 82*b* is supported on an outer lateral surface 57 of the cutoff member 53. Thus, the air generated from the cooling fan 63 is primarily sealed by the flat surface 83 and the upper end 54 of the cutoff member 53 and is secondarily sealed by the inclined surface 84 and the outer lateral surface 57 of the cutoff member 53, so that the air is prevented from flowing between the condenser cover 50 and the cooling fan cover 80.

Figure 7:
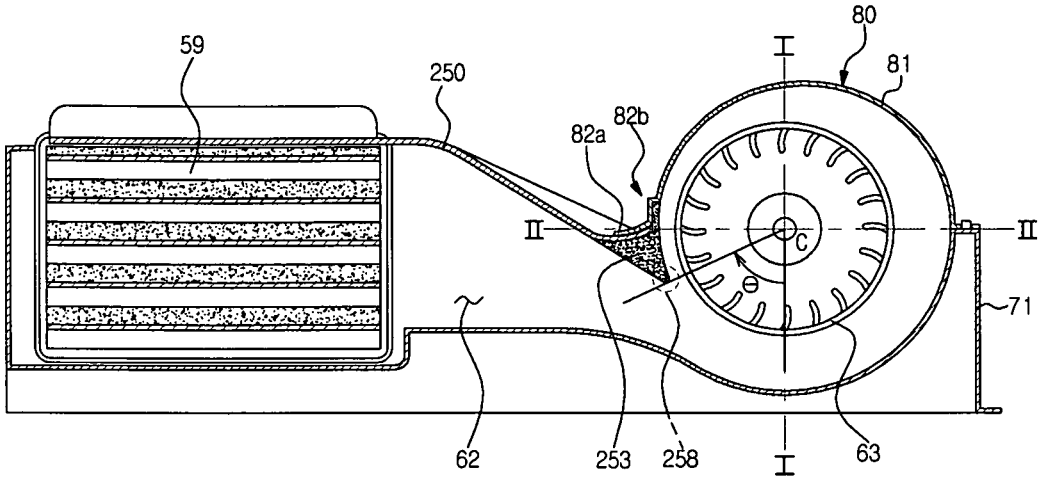
FIG. 7 illustrates a view showing a cooling fan having a cutoff member according to embodiments of the present invention.

FIG. 7 illustrates a view showing the cooling fan having a cutoff member according to embodiments of the present invention.

Referring to FIGS. 4 and 7, the cutoff member 53 shown in FIG. 4 is integrally formed with the condenser cover 50 through the injection molding process, and the cutoff member 253 shown in FIG. 7 is prepared separately from the condenser cover 250 and the cooling fan cover 80 so that the cutoff member 253 can be coupled to the condenser cover 250 or the cooling fan cover 80. A welding process can be performed in order to couple the cutoff member 253 to the condenser cover 250 or the cooling fan cover 80.

If the cutoff member 253 is coupled to the condenser cover 250 and the cooling cover 80 as shown in FIG. 7, many process steps may be required as compared with the case in which the cutoff member 53 is integrally formed with the condenser cover 50 through the injection molding process. Nevertheless, the quantity of air generated from the cooling fan 63 can be increased by positioning the cutoff 258 of the cooling fan 63 below the rotational center C of the cooling fan 63.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An external air path duct forming an external air path in a clothing dryer, the duct comprising:

a first cover covering a cooling fan; and a second cover separately formed from the first cover and connected to the first cover, a portion of the first cover being supported on an upper surface of the second cover to prevent air flow generated by the cooling fan from leaking between the first cover and the second cover;

a cutoff member provided at a connection area between the first cover and the second cover to guide the external air path, wherein when the cooling fan is installed in the duct, and the cutoff member is located below a rotational center of the cooling fan, the cutoff member being integrally formed with the second cover.

2. The external air path duct as claimed in claim 1, wherein a cutoff positioned on the end of the cutoff member is inclined 70 degrees or less from a vertical line passing through the rotational center of the cooling fan.

3. The external air path duct as claimed in claim 1, wherein the first cover includes a sealing structure formed by a first support section to prevent airflow from the cooling fan from exiting out the connection area.

4. The external air path duct as claimed in claim 1, wherein the first cover includes a section having a semi-cylindrical shape.

5. An external air path duct forming an external air path in a clothing dryer, the duct comprising:

a first cover covering a cooling fan; and a second cover separately formed from the first cover and connected to the first cover, a portion of the first cover being supported on an upper surface of the second cover to prevent air flow generated by the cooling fan from leaking between the first cover and the second cover;

a cutoff member provided at a connection area between the first cover and the second cover to guide the external air path, wherein when the cooling fan is installed in the duct, and the cutoff member is located below a rotational center of the cooling fan at an end of the second cover provided around the cooling fan.

6. The external air path duct claimed in claim 1, wherein the second cover covers a condenser.

7. The external air path duct claimed in claim 1, wherein a top of the external air path duct is formed by the first and second covers, and a bottom of the external air path duct is formed in a base of the clothing dryer.

8. The external air path duct as claimed in claim 1, wherein the cutoff member has a wedge shape with one side being curved proportional to the curvature of the cooling fan, and another side extending away from the cooling fan.

9. The external air path duct as claimed in claim 8, wherein a cutoff positioned on the end of the cutoff member is located where the one side meets the other side.

10. A clothing dryer comprising:

a base; and a base cover coupled with the base to form a fluid path, wherein the base cover includes a first cover covering a cooling fan and a second cover separately formed from the first cover and connected to the first cover and a portion of the first cover is supported on an upper surface of the second cover to prevent air flow generated by the cooling fan from leaking between the first cover and the second cover, wherein a cutoff is provided at a connection area between the first cover and the second cover to guide the fluid path, wherein when the cooling fan is installed on the base, the cutoff being located below a rotational center of the cooling fan, and wherein a cutoff member is provided at the connection area between the first cover and the second cover along an outer peripheral surface of the cooling fan, and the cutoff is provided at a lower end of the cutoff member, the cutoff member being integrally formed with the second cover though an iniection molding process.

11. The clothing dryer as claimed in claim 10, wherein the cutoff member is connected to the first cover, thereby forming a radial configuration together with the first cover about the rotational center of the cooling fan.

12. The clothing dryer as claimed in claim 10, wherein the first cover includes a second support section supported by the cutoff member.

13. The clothing dryer as claimed in claim 12, wherein the second support section includes a flat surface and an inclined surface, which are formed in a stepped configuration, the flat surface is supported on an upper end of the cutoff member, and the inclined surface is supported on a lateral side of the cutoff member.

14. The clothing dryer as claimed in claim 10, wherein the first cover includes a first support section supported by the second cover.

15. The clothing dryer as claimed in claim 10, wherein the first cover includes a radial section, and the second cover includes a linear section.

16. The clothing dryer as claimed in claim 10, wherein the base includes an external air path and a hot air circulation path, a condenser is installed at an intersection between the external air path and the hot air circulation path, and the cooling fan is installed in the external air path.

17. The clothing dryer as claimed in claim 16, wherein the condenser and the cooling fan are installed in a recess of the base.

18. A clothing dryer comprising:

a base;

a cooling fan installed on the base;

a condenser installed on the base;

a cooling fan cover coupled to the base to cover the cooling fan;

a condenser cover coupled to the base to cover the condenser and separately formed from the cooling fan cover, a portion of the cooling fan cover being supported on an upper surface of the condenser cover to prevent air flow generated by the cooling fan from leaking between the cooling fan cover and the condenser cover; and a cutoff member connected to the cooling fan cover to guide a flow of air generated from the cooling fan, wherein the cooling fan cover forms a radial configuration together with the cutoff member along an outer peripheral surface of the cooling fan in a range of 180 degrees or more, and wherein when the cooling fan is installed on the base and rotates to generate an air flow, a part of the cutoff member is located below a rotational center of the cooling fan.

* * * * *

UNITED STATES PATENT AND TRADEMARK OFFICE

CERTIFICATE OF CORRECTION

PATENT NO. : 8,615,896 B2
APPLICATION NO. : 12/461618
DATED : December 31, 2013
INVENTOR(S) : Chung It is certified that error appears in the above-identified patent and that said Letters Patent is hereby corrected as shown below:

In the Claims

Column 9, Line 23, In Claim 10, delete “iniection” and insert -- injection --, therefor.

Signed and Sealed this
First Day of July, 2014

Michelle K. Lee

Michelle K. Lee
*Deputy Director of the United States Patent and Trademark Office*